United States Patent [19]

Mizelle

[11] 4,222,135

[45] Sep. 16, 1980

[54] BED FRAME WITH IMPROVED LEG SUPPORTS

[75] Inventor: Ned W. Mizelle, Lexington, Ky.

[73] Assignee: Hoover Universal, Inc., Saline, Mich.

[21] Appl. No.: 4,679

[22] Filed: Jan. 19, 1979

[51] Int. Cl.[2] ..... A47C 19/00

[52] U.S. Cl. ..... 5/310; 5/282 R

[58] Field of Search ..... 182/228; 403/167, 248; 5/310, 425, 282 R, 279 R

[56] References Cited

U.S. PATENT DOCUMENTS

| | | | |
|---|---|---|---|
| 3,105,976 | 10/1963 | Roche | 5/310 |
| 3,168,938 | 2/1965 | Shaver | 182/228 |
| 3,881,572 | 5/1975 | Zenhausern | 182/228 |
| 4,038,710 | 8/1977 | Tambascio | 5/310 |

*Primary Examiner*—Casmir A. Nunberg

*Attorney, Agent, or Firm*—Olsen and Stephenson

[57] ABSTRACT

One-piece tubular supporting legs for a bed-carrying frame having rectangular hollow side and end rails. Top and bottom openings in the end rails define upright passageways into which the supporting legs are inserted. Each supporting leg comprises an elongated body from which an integral flange portion radially extends at a position between the ends of the body. When fully inserted into an associated passageway, the end rail surrounding the bottom opening rests on the flange portion which thus transfers downwardly directed bedding loads to the body. The top of the body extends through the top opening and is deformed to form a head which engages the rail surrounding the top opening to cooperate with the flange portion in securing the leg to the frame.

7 Claims, 4 Drawing Figures

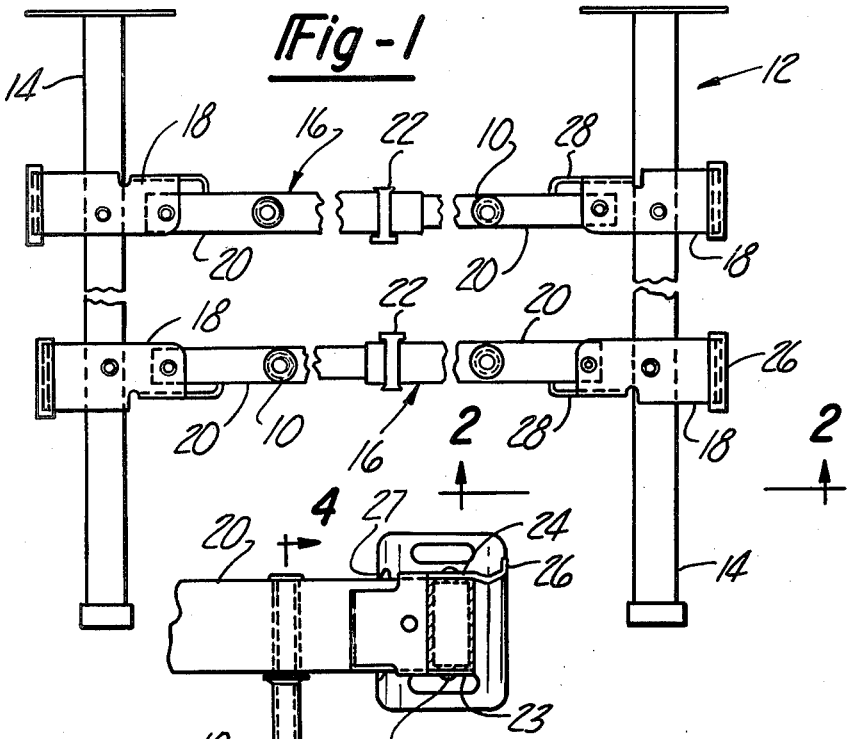
Fig-1
Fig-2
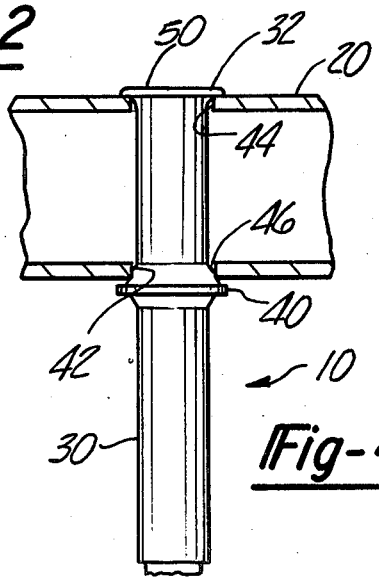
Fig-4
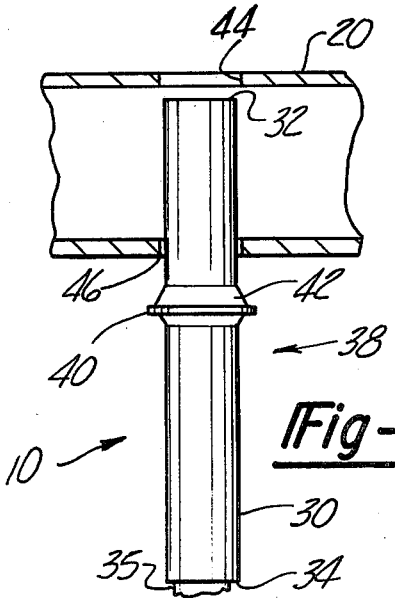
Fig-3

BED FRAME WITH IMPROVED LEG SUPPORTS

BACKGROUND OF THE INVENTION

The present invention relates to a bed-carrying frame having improved supporting leg structure.

Bed-carrying frames consist of side and end rails usually formed from angle sections, and supporting legs secured to the rails usually consist of several assembled parts and they are usually riveted or welded to the rails. Affixing the legs to the frame in this manner is costly as well as time consuming and still does not provide the most efficient arrangement for supporting the bed-carrying frame. Welds fail, rivets loosen, and assembled parts come apart in service.

It is therefore the general object of this invention to provide improved bed-carrying frame and leg assembly in which the supporting leg is of unitary construction. It is yet another object of this invention to provide an improved bed-carrying frame and leg assembly in which the leg is quickly and reliably secured to the frame.

SUMMARY OF THE INVENTION

The present invention provides an improved supporting leg for a bed-carrying frame consisting of side rail members and end rail units connected to the side rail members. A bed-carrying frame of this type is disclosed in U.S. Pat. No. 4,061,061, assigned to the assignee of this application. The side rail members are of a hollow rectangular construction. The end rail units comprise generally rectangular hollow members that are telescoped within each other to enable the width of the bed-carrying frame to be varied to accommodate various mattress and box spring widths.

Aligned openings are formed in the end rail members near the corners of the bed-carrying frame and each receives a supporting leg which in turn receives a caster enabling movement of the bed-carrying frame on the floor. Each supporting leg consists of an upright one-piece elongated body member of tubular shape having an integrally formed flange extending radially therefrom between its upper and lower ends. When the body member is inserted upwardly through frame rail openings, the flange engages the portion of the end rail member surrounding the bottom opening. This engagement serves to transfer the downwardly directed load applied by the bed-carrying frame to the tubular body member thereby efficiently utilizing the columnar load-carrying strength of the body member.

The top portion of the body member extends upwardly through the opening in the frame rail top well. The top end of the body member is deformed to form a head which engages the top surface of the end rail and fills the top wall opening. The head thus cooperates with the flange to securely clamp the rail therebetween and secure it to the supporting leg.

The flange is formed so that it has a collar portion with an upwardly and inwardly inclined conical surface that fills the rail bottom wall opening so as to restrain transverse shifting of the supporting leg in the end rail. Similarly, the head of the body member fills the passageway at the top wall opening to inhibit transverse shifting of the upper portion of the supporting leg relative to the rail.

By virtue of the flange being an integral extension of the elongated body member, downwardly directed forces applied to the flange are efficiently transferred to the body member. Consequently, the columnar strength of the body member is advantageously employed enabling less material to be used in forming the supporting legs.

Further objects, features, and advantages of the present invention will become apparent from a consideration of the following description when taken in connection with the appended claims and the accompanying drawing in which:

FIG. 1 is a foreshortened plan view of the bed-carrying frame and supporting leg assembly of this invention;

FIG. 2 is a fragmentary elevational view of a portion of the bed-carrying frame and leg assembly shown in FIG. 1;

FIG. 3 is a sectional elevational view showing the supporting leg of the present invention partially assembled with the bed-carrying frame; and FIG. 4 is a fragmentary view like FIG. 3 showing the leg fully assembled with the frame and taken substantially from line 4—4 in FIG. 2.

With reference to the drawing, the supporting leg of this invention, indicated generally at 10, is shown in FIGS. 1 and 2 assembled with a bed-carrying frame 12. The frame 12 includes a pair of parallel side rails 14, a pair of end rails 16, and four corner bracket members 18 which serve to connect the side rails 14 with the end rails 16. The general configuration of the bed-carrying frame 12 is disclosed in U.S. Pat. No. 4,070,717, assigned to the assignee of this application, and will be described only to the extent necessary to understand the present invention.

The side rails 14 are identical and are of a generally rectangular hollow configuration. Similarly, the end rails 16 are identical, each consisting of a pair of relatively telescoped end rail members 20, which are also of rectangular hollow shape, one of the end rail members 20 being slightly smaller than the other so that it can be telescoped inside the larger rail member 20. Latching members 22 are mounted on the end rail members 20 to retain the end rail members 20 in fixed adjusted positions.

The corner brackets 18 are also substantially identical, the pair of brackets 18 on each side rail 14 being right and left handed versions of the same structure. Each bracket member 18 has vertically spaced, horizontally extending portions 23 and 24 which straddle the associated side rail member 14. A locking pin 25 extends through the side rail member 14 and connects the portions 23 and 24 to the side rail member 14. The upper portion 24 includes an upright flange extension 26 positioned outwardly of the side rail 14 which serves to locate a box spring on the bed-carrying frame 12.

The bracket member 18 also includes an upright plate 28 extending inwardly of and oriented perpendicular to the side rail member 14. Each end rail member 20 is attached by a pivot 27 to an associated corner bracket 18 and is movable between the assembled position shown in FIG. 1 and a collapsed position in which the end rail member 20 is generally parallel with the side rail 14. The upright plate 28 serves as a locating means establishing a stop against which the associated end rail member 20 is located to be in a perpendicular position with respect to the side rail 14 when the end rail member 20 is pivoted to its assembled position.

Each supporting leg 10, as seen in FIGS. 2–4, comprises a one-piece elongated body member 30, which, in the preferred embodiment, consists of a cylindrical hollow tube. The body member 30 has an upper end 32 and a lower end 34 through which a caster stem 35 on a caster 36 is disposed for pivotal movement about a vertical axis. A flange 38 is integrally formed on the body member 30 at a location between its upper end 32 and its lower end 34. The location of the flange portion 38 is dependent upon the vertical height of the end rail member 20 to which it is attached so that when installed, the upper end 32 extends slightly beyond the top surface of the rail member 20. The flange 38 is formed by well-known metal-forming techniques such as swedging, for example, in which the ends of the elongated body member 30 are compressed while it is positioned in a die having a cavity into which a portion of the body member 30 is forced to form the flange 38. The flange 38 includes a generally horizontal rim portion 40 and a collar portion 42 having a tapered surface that extends upwardly from the rim portion 40 and inwardly toward the body member 30.

The end rail member 20 includes an upwardly facing or top wall opening 44 and a downwardly facing or bottom wall opening 46 that is aligned with the opening 44. When the body member 30 is inserted upwardly through the aligned openings 44 and 46, as shown in FIGS. 3 and 4, the flange 38 engages the portions of rail member 20 surrounding the bottom opening 46. Thus, with the member 30 fully inserted in the opening 46, the flange 38 receives and transfers the downwardly directed loads applied by the bed-carrying frame 12 to the body member 30.

The portion of the body member 30 above the flange 38, as explained above, is of a sufficient length so that when the member 30 is inserted into the opening 46, the upper end 32 of the body member extends slightly beyond the top wall of the end rail member 20. The outer diameter of the body member 30 is slightly smaller than the diameters of the openings 44 and 46 to expedite the assembly procedure. When the leg 10 is fully inserted into the opening 46, the collar portion 42 fills the bottom opening 46 and engages the rail member 20 thereat to prevent lateral shifting of the body member 30 in the bottom opening 46.

As shown in FIG. 4, after the supporting leg 10 is installed in the opening 46, the upper end 32 then is deformed to form a head 50 which engages the upper surface of the rail member 20 at positions surrounding the top opening 44. Flaring the upper end 32 of the body member 30 outwardly also expands the outwardly tapers it causing it to fill the hole 44 and engage the rail member 20 to thereby prevent transverse shifting of the body member 30 within the top opening 44. The head-forming procedure also draws the flange 38 upwardly forcing the collar portion 42 into the bottom opening 46 to provide a tight mounting of the supporting leg 10 on the rail member 20.

It is significant that the flange portion 38 is an integral extension of the body member 30. If on the other hand, an annular ring member was welded to the body member 30, an inadequate supporting leg would result, for a welded ring would inefficiently transfer the downwardly directed forces to the body member 30 and could easily be stripped from the body member if subjected to an unusual load. The present invention takes advantage of the columnar strength of the elongated body member 30 because the flange portion 38 is an integral extension of the body member 30. Downwardly directed forces applied to the flange portion 38 are efficiently transferred to the body member 30 utilizing the maximum load-carrying capabilities of the leg 10 which in turn enables less material to be used than would otherwise be the case.

From the above description, it can be seen that an improved supporting leg arrangement is provided wherein the flange 38 comprises an integral, radially extending portion of the body member for engaging and supporting the frame. The supporting leg 10 is affixed to the bed-carrying frame 12 without the use of rivets, welding, or the like. The tapered construction of the collar portion 42 along with the tapered shape of the head 50 prevents lateral shifting of the body member 30 in the top and bottom openings 44 and 46. Also, formation of the head 50 clamps the rail member 20 between the head and the flange 38 providing a secure and tight mounting of the leg 10 on the rail member 20. The leg 10 is highly efficient, strong, and yet is easily and inexpensively manufactured and assembled and is not dependent on any particular shape of rail since it can readily be adapted to rails of shapes other than the preferred shape shown and described herein.

What is claimed:

1. In combination with a bed-carrying frame having side and end rails each having top and bottom surfaces, a supporting leg comprising an elongated body member having a hollow top end and a bottom end, a portion of said body member intermediate the ends thereof having integral flange means extending transversely outwardly from said body member, said flange means having a collar portion extending upwardly toward said top end of said body member, means providing upright opening means in one of said rails of a size larger than the cross sectional size of the portion of said body member between said flange means and said top end thereof to enable said body member to be extended upwardly therethrough, said body member being disposed in said opening means at a position in which said collar portion extends into and fills said opening means adjacent the bottom surface of said one rail, said collar portion being operable to transfer downwardly directed loads on said frame to said body member at said flange means and to constrain transverse movement of said body member in said opening means, said body member extending upwardly from said flange means through said opening means and beyond said rail top surface, the top end of said body member being deformed so as to form a head engaged with said rail top surface to thereby clamp said rail between said flange means and said head.

2. The structure according to claim 1 wherein said collar portion has a tapered surface which extends upwardly and inwardly into said opening means into engagement with said rail whereby increased downward loads on said bed frame further constrains transverse movement of said body member in said opening means.

3. The structure according to claim 1 wherein said body member head is tapered and extends into said opening means into engagement with said rail.

4. The structure according to claim 1 wherein said body member comprises a hollow cylindrical tube.

5. The structure according to claim 4 wherein said flange means comprises a circular rim surrounding said body member and extending radially outwardly therefrom.

6. A bed-carrying frame and supporting leg assembly comprising hollow rectangular frame members at least one of which has a pair of vertically aligned top and bottom openings, said supporting leg comprising an elongated body member of tubular shape having top and bottom ends, integral flange means on said body member extending radially outwardly from said body member at a location between the ends thereof, said flange means comprising a collar portion extending upwardly toward said top end of said body members, said body member being disposed in a supporting position in said aligned top and bottom openings in said frame member in which said flange means engages said frame member adjacent said bottom opening to support said frame member and in which said collar portion is positioned in and substantially fills said bottom opening to constrain transverse movement of said body member in said bottom opening, and the portion of said body member above said flange means extends upwardly through said bottom and top openings, said top end of said body member being deformed to form a head engaged with said frame member adjacent said top opening so as to clamp said frame member between said head and said flange means.

7. A supporting leg comprising a hollow cylindrical body member, an integral flange portion formed from said body member at a preselected location between the ends of said body member, said integral flange portion essentially surrounding said body member and being operable to transfer to said body member the entire axial component of a load applied to said flange portion so that the columnar load carrying capability of said cylindrical body member is fully utilized, said flange portion including a collar portion tapering inwardly toward said body member in a direction extending toward one end of said member, said collar portion being adapted to substantially fill an opening in which said body member is disposed to constrain transverse movement thereof in the opening, said one end of said cylindrical body member being deformed to form a head portion that essentially surrounds said body member and extends radially therefrom, said head portion and said flange portion being spaced apart a predetermined distance and being operable to clampingly mount said body member on mounting surfaces located between said head portion and said flange portion and spaced apart a distance substantially equal to said predetermined distance.

* * * * *